US009084920B2

(12) United States Patent
Andochick

(10) Patent No.: US 9,084,920 B2
(45) Date of Patent: Jul. 21, 2015

(54) GOLF CLUB CARRYING CASE

(76) Inventor: Scott E. Andochick, Potomac, MD (US)

( * ) Notice: Subject to any disclaimer, the term of this patent is extended or adjusted under 35 U.S.C. 154(b) by 325 days.

(21) Appl. No.: 13/313,138

(22) Filed: Dec. 7, 2011

(65) Prior Publication Data

US 2012/0074004 A1 Mar. 29, 2012

Related U.S. Application Data

(62) Division of application No. 12/333,081, filed on Dec. 11, 2008, now abandoned.

(51) Int. Cl.

| | |
|---|---|
| ***A63B 55/00*** | (2006.01) |
| ***A63B 55/08*** | (2006.01) |
| *A45B 7/00* | (2006.01) |
| *A45C 5/14* | (2006.01) |
| *A45C 5/08* | (2006.01) |

(52) U.S. Cl.

CPC ..... *A63B 55/00* (2013.01); *A63B 55/08* (2013.01); *A45B 7/00* (2013.01); *A45C 5/08* (2013.01); *A45C 5/14* (2013.01); *A63B 2210/50* (2013.01)

(58) Field of Classification Search

CPC .... A63B 55/00; A63B 55/08; A63B 2210/50; A45C 7/00; A45C 5/14; A45C 5/08

USPC ..... 206/315.3; 220/4.22, 4.23

See application file for complete search history.

(56) References Cited

U.S. PATENT DOCUMENTS

| | | | | |
|---|---|---|---|---|
| 299,216 | A | | 5/1884 | Goodwin |
| 394,994 | A | | 12/1888 | Poliwka |
| 632,167 | A | | 8/1899 | Biesmeyer |
| 1,014,475 | A | | 1/1912 | Holloway |
| 1,111,859 | A | | 9/1914 | Powell |
| 1,325,692 | A | * | 12/1919 | Cross ..... 206/315.4 |
| D57,526 | S | | 4/1921 | Hunt |
| 1,414,875 | A | | 5/1922 | Hanaford |
| 1,460,769 | A | | 7/1923 | Saunders |
| 1,903,798 | A | | 4/1933 | Turner |
| 1,911,713 | A | | 5/1933 | Pravda |
| 2,000,400 | A | | 5/1935 | MacLaren |
| 2,002,581 | A | | 5/1935 | Osten |
| 2,023,727 | A | | 12/1935 | Esser |
| 2,650,449 | A | * | 9/1953 | Suring ..... 43/26 |
| 2,736,513 | A | | 2/1956 | Amann et al. |
| 2,982,458 | A | | 5/1961 | Hennion |
| D201,400 | S | | 6/1965 | Kneeland et al. |
| 3,317,110 | A | | 5/1967 | Palmer |
| 3,337,028 | A | | 8/1967 | Glavan |
| 3,520,561 | A | | 7/1970 | Rininger |
| D219,417 | S | | 12/1970 | Heidtman et al. |
| 3,655,153 | A | | 4/1972 | Terrell |
| 3,690,593 | A | | 9/1972 | Kettering |
| 3,733,037 | A | | 5/1973 | Vandiveer |
| 3,880,335 | A | * | 4/1975 | Winkler ..... 224/42.13 |

(Continued)

*Primary Examiner* — Tri Mai

(74) *Attorney, Agent, or Firm* — Leveque IP Law, P.C.

(57) ABSTRACT

A golf club carrying case has first and second elongated shells connected along a first longitude edge by one or more hinges. At least one closing mechanism is used to hold the first and second elongated shells together, along a second longitude edge, to form an elongated housing. A number of restraints are used to restrain golf clubs within the elongated housing. The first and second elongated shells are shaped such that one end of the elongated housing is large enough to accommodate the heads of driver clubs and the lengths of the first and second elongated shells are sufficient to accommodate the maximum length of a driver club.

28 Claims, 6 Drawing Sheets

(56) References Cited

U.S. PATENT DOCUMENTS

| | | | | | |
|---|---|---|---|---|---|
| 3,899,100 | A | | 8/1975 | Rigaud | |
| 3,912,156 | A | | 10/1975 | May | |
| 3,927,790 | A | | 12/1975 | Chase et al. | |
| 4,134,431 | A | | 1/1979 | Davidson et al. | |
| 4,324,511 | A | | 4/1982 | Irish | |
| 4,361,947 | A | | 12/1982 | Arnaud | |
| 4,362,443 | A | | 12/1982 | Mallory et al. | |
| RE31,123 | E | | 1/1983 | Simmons | |
| 4,378,883 | A | * | 4/1983 | Profeta | 206/335 |
| 4,576,307 | A | * | 3/1986 | Frydenberg | 220/324 |
| 4,619,291 | A | | 10/1986 | Shirian | |
| 4,643,302 | A | | 2/1987 | Baumgardner | |
| 4,747,431 | A | | 5/1988 | LaCount et al. | |
| 4,774,872 | A | | 10/1988 | Creedon | |
| 4,792,055 | A | * | 12/1988 | Schupack et al. | 220/324 |
| 4,860,935 | A | | 8/1989 | Pavlinsky | |
| D320,183 | S | | 9/1991 | Jacobsson et al. | |
| 5,234,144 | A | | 8/1993 | Iler | |
| D341,717 | S | | 11/1993 | Hickin | |
| 5,327,669 | A | * | 7/1994 | Lannan et al. | 43/26 |
| 5,333,731 | A | | 8/1994 | McCuaig | |
| 5,352,309 | A | | 10/1994 | Oswalkd | |
| 5,425,194 | A | | 6/1995 | Miller | |
| D360,296 | S | | 7/1995 | Hunsaker | |
| 5,492,346 | A | * | 2/1996 | Stadler et al. | 280/47.19 |
| 5,538,137 | A | * | 7/1996 | Deioma et al. | 206/579 |
| 5,547,052 | A | * | 8/1996 | Latshaw | 190/108 |
| 5,900,293 | A | | 5/1999 | Zettle | |
| 5,906,277 | A | * | 5/1999 | Vienneau | 206/315.1 |
| D414,035 | S | | 9/1999 | Stokes | |
| D416,678 | S | | 11/1999 | Kurtz et al. | |
| 6,050,373 | A | * | 4/2000 | Wonka et al. | 190/103 |
| 6,161,507 | A | | 12/2000 | French | |
| 6,161,692 | A | * | 12/2000 | Lizarraga | 206/315.3 |
| D436,439 | S | | 1/2001 | Dennesen et al. | |
| 6,217,042 | B1 | * | 4/2001 | Kurtz et al. | 280/37 |
| 6,279,740 | B1 | | 8/2001 | Dorman | |
| D453,622 | S | | 2/2002 | McClenahan et al. | |
| 6,352,154 | B1 | * | 3/2002 | Miura | 206/315.6 |
| 6,422,414 | B1 | | 7/2002 | Nakamura et al. | |
| 6,450,333 | B1 | * | 9/2002 | McClenahan et al. | 206/315.11 |
| 6,472,007 | B2 | | 10/2002 | Bezek et al. | |
| 6,491,193 | B2 | | 12/2002 | Dudek et al. | |
| 6,557,702 | B1 | | 5/2003 | Sanderson et al. | |
| D483,178 | S | * | 12/2003 | Fiore, Jr. | D3/254 |
| D507,874 | S | | 8/2005 | Hesmer | |
| 7,077,252 | B2 | * | 7/2006 | Sanchez | 190/108 |
| 7,125,053 | B2 | | 10/2006 | Hashem | |
| 7,178,687 | B1 | | 2/2007 | Manderfield et al. | |
| D560,788 | S | | 1/2008 | Farrell et al. | |
| 7,703,664 | B2 | | 4/2010 | Westphal et al. | |
| 7,752,827 | B2 | | 7/2010 | Learn et al. | |
| 7,789,229 | B2 | | 9/2010 | Frakes | |
| 7,878,911 | B2 | | 2/2011 | Horen | |
| 8,002,133 | B2 | | 8/2011 | Galownia et al. | |
| 8,066,138 | B2 | | 11/2011 | Boyles | |
| 8,397,944 | B1 | | 3/2013 | Landes | |
| 2002/0017502 | A1 | | 2/2002 | Renz | |
| 2003/0116456 | A1 | * | 6/2003 | Ueno | 206/315.3 |
| 2004/0211687 | A1 | | 10/2004 | Rodriguez | |
| 2006/0102672 | A1 | * | 5/2006 | Godshaw | 224/572 |
| 2006/0119058 | A1 | * | 6/2006 | Murillo | 280/47.27 |
| 2006/0185998 | A1 | | 8/2006 | McGrail et al. | |
| 2008/0023356 | A1 | | 1/2008 | Manaster et al. | |
| 2011/0092307 | A1 | | 4/2011 | Benedictson | |

* cited by examiner

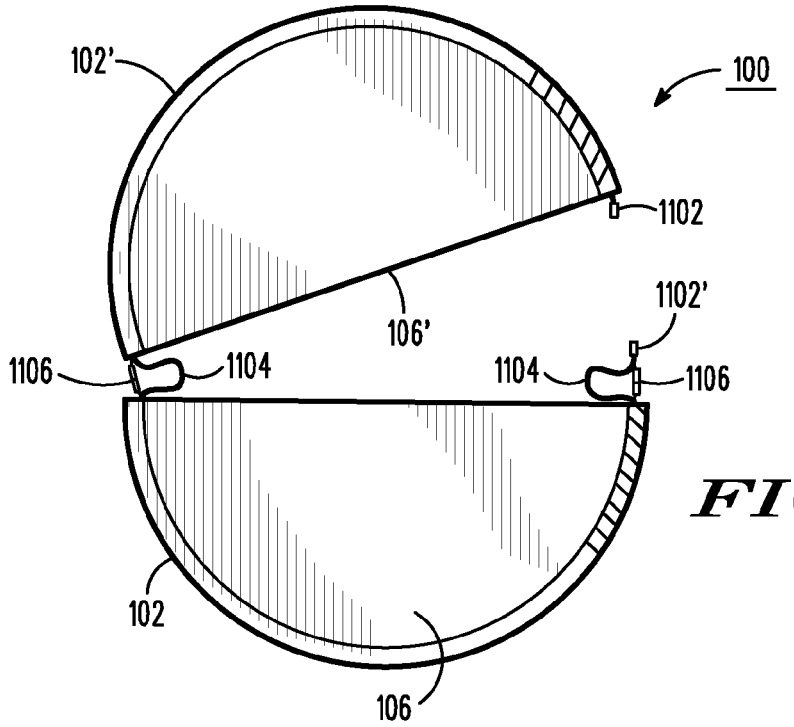
FIG. 11
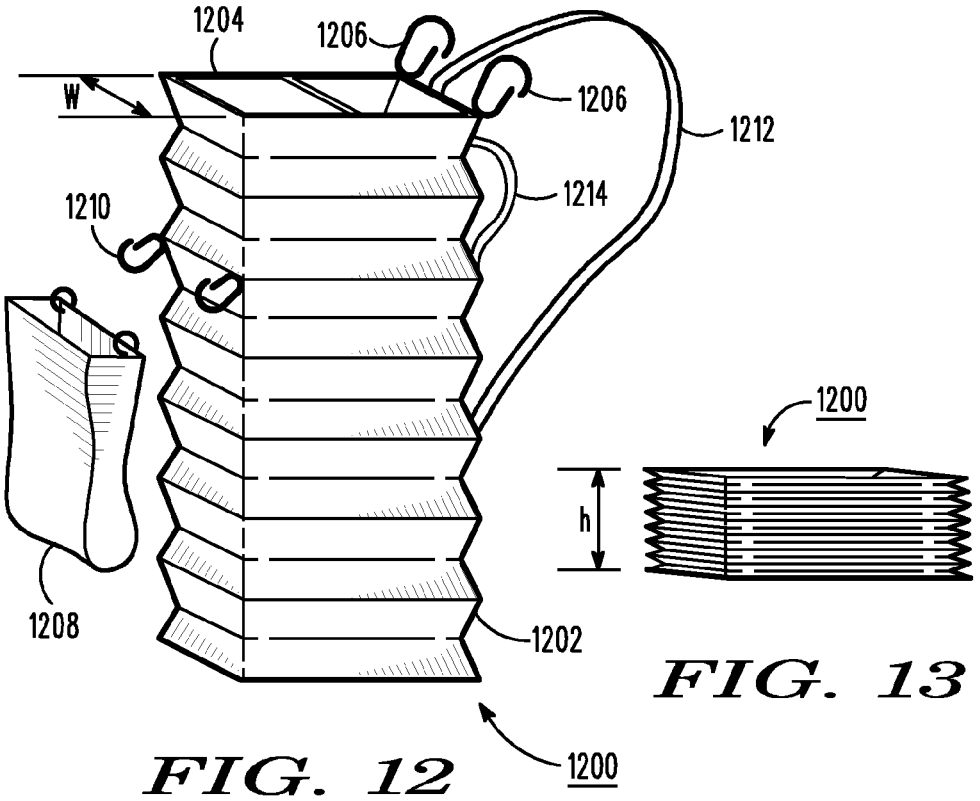
FIG. 13
FIG. 12

GOLF CLUB CARRYING CASE

This application is a divisional application of co-pending application Ser. No. 12/333,081 filed on Dec. 11, 2008, the entire disclosure of which is incorporated into this application by reference and to which the instant application claims priority.

BACKGROUND

Bags for carrying golf clubs are typically rigid or soft wall cylindrical bags that have an opening at one end to allow golf clubs to be inserted and removed.

Commonly, bags used in play are made of a flexible material, which is more comfortable when the bag is carried or larger more rigid structure designed to be placed on a golf cart. Bags used for transporting clubs are more rigid, with golf clubs inserted at one end of the bag, and include a means for closing the end of the bag.

Golf clubs and bags are usually packed together for airline travel in a larger case made of rigid, impact resistant material or a soft padded case. These bags typically have two wheels and a handle to enable to bag to be wheeled through airports.

Cylindrical bags may be made up of several tubular sections that are assembled to form a bag.

Similar carrying cases are used for carrying other elongated implements, such as fishing rods.

A common problem with bags used for transporting golf clubs is that they are large and cumbersome.

BRIEF DESCRIPTION OF THE FIGURES

The accompanying figures, in which like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 11 is a cross-section of a further golf club carrying case in accordance with certain embodiments of the invention.

FIGS. 12 and 13 are diagrammatic representations of a collapsible golf bag in accordance with some embodiments of the invention.

Figure 1:
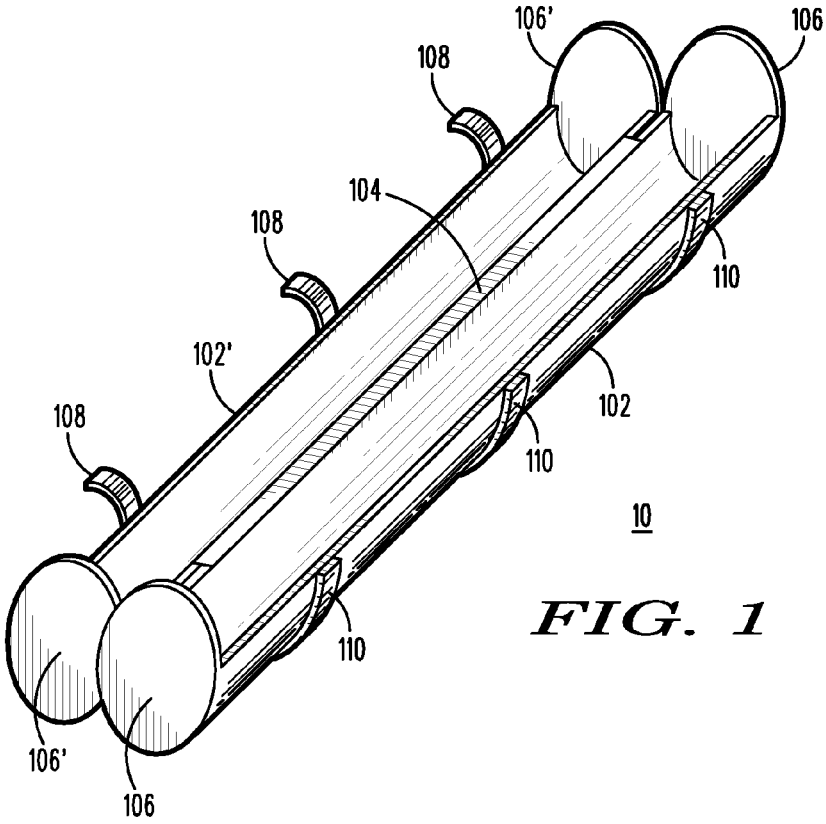
FIG. 1 is a diagram of an open golf club carrying case in accordance with some embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to the transportation of golf clubs. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

In one embodiment, a golf club carrying case has first and second elongated shells connected along a first longitude edge by one or more hinges. At least one closing mechanism is used to hold the first and second elongated shells together, along a second longitude edge, to form an elongated housing. A number of restraints are used to restrain golf clubs within the elongated housing. The first and second elongated shells are shaped such that one end of the elongated housing is large enough to accommodate the heads of driver clubs and the lengths of the first and second elongated shells are sufficient to accommodate the maximum length of a driver club.

FIG. 1 is a diagram of an open golf club carrying case 10 in accordance with some embodiments of the invention. Referring to FIG. 1, the golf club carrying case 10 comprises a first elongated shell 102 and a second elongated shell 102'. In this example, the first and second shells have a semi-circular cross-section. However, other cross-section profiles may be used, such as rectangular or oval for example.

The first and second elongated shells are coupled along one longitudinal edge by one or more hinges 104. The hinge 104 allows the first and second shells to be brought together to form a closed case. In this example, the closed case is a tube. In general, the closed shells form an elongated housing. The first shell 102 includes ends 106 and the second shell 102' includes ends 106'. The shells and their ends are made of a substantially rigid material, such as a plastic. The ends may be circular (or other shape) such that when the shells are brought together, the ends 106' are inside the tube so that ends of the closed tube have double thickness to increase strength. Alternatively, the shells 102 and 102' may have equal lengths and the ends may be semi-circular (or other shape) such that the ends butt together when the shells are brought together.

The shells are held together by closing mechanisms 108 and 110. 108 and 110 may be constructed of hook-and-loop material for example. Other locking mechanisms may be used such as zips, latches, snaps, elastic bands and straps with buckles.

Figure 2:
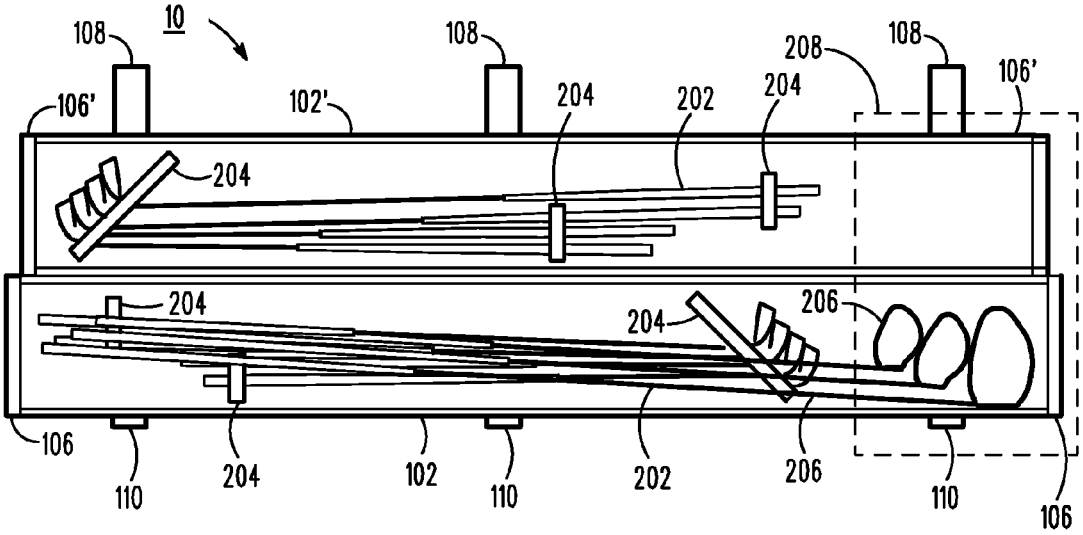
FIG. 2 is a further diagram of an open golf club carrying case in accordance with some embodiments of the invention.

FIG. 2 is a further diagram of an open golf club carrying case 10 in accordance with some embodiments of the invention. In FIG. 2, the golf club carrying case 10 holds golf clubs 202, such as irons, wedges and putters, held in place by one or more restraints 204. The restrains may be elastic straps, hook-and-loop straps, foam inserts, clips, or dividers, for example. The golf club carrying case also holds larger golf clubs 206, such as woods or drivers. Soft inserts may be used to hold clubs in position and protect them from movement.

Commonly, the woods or drivers 206 have longer shafts and larger heads. In one embodiment of the invention, the golf club carrying case 10 is sized such that the length of the golf club carrying case is greater than the length of the longest driver 206 and the cross section of the golf club carrying case, at least in the region 208, is sufficient to contain the driver with the largest head. In addition, in one embodiment, the sum of the length, width and depth of the golf club carrying case is no greater than maximum length allowed by airlines for standard sized luggage. For example, in one embodiment the sum of the length, width and depth of the golf club carrying case is no more than 62 inches. In one embodiment, the maximum cross-dimension of the end that accommodates the driver heads is no more than approximately 6 inches and the length of the carrying case is no more than approximately 50 inches.

The golf club carrying case may be sized to hold a full set of 14 golf clubs or a half set of 7 golf clubs.

Figure 3:
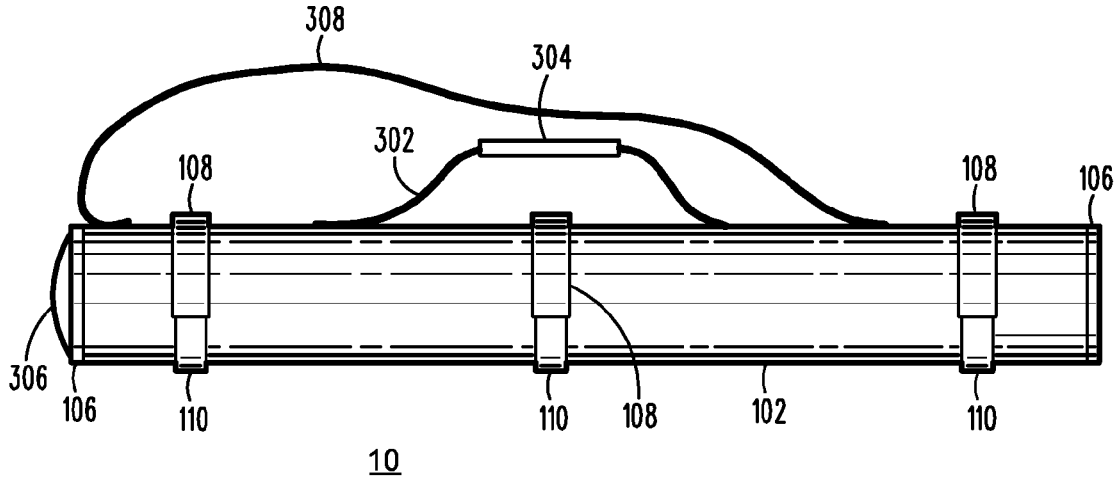
FIG. 3 is a diagram of a closed golf club carrying case in accordance with some embodiments of the invention.

FIG. 3 is a diagram of a closed golf club carrying case in accordance with some embodiments of the invention. When closed, the closing mechanisms 108 and 110 are engaged and the two shells are held together to form a tube. The golf club carrying case may be carried in a substantially horizontal orientation using carrying handle 302. The handle 302 may be a flexible handle, such as a strap or rope, or a rigid handle, for example. When a flexible handle is used, a sleeve 304 may be placed over the strap to provide a more comfortable grip or to increase the stiffness of the handle in the central region. Second handles 306 may be located on one or both ends of golf club carrying case. In a further embodiment, a shoulder strap 308 is removably or fixedly attached the carrying case to allow the case to be carried in a more vertical orientation. In a further embodiment, the handle takes the form of a shoulder strap.

Figure 4:
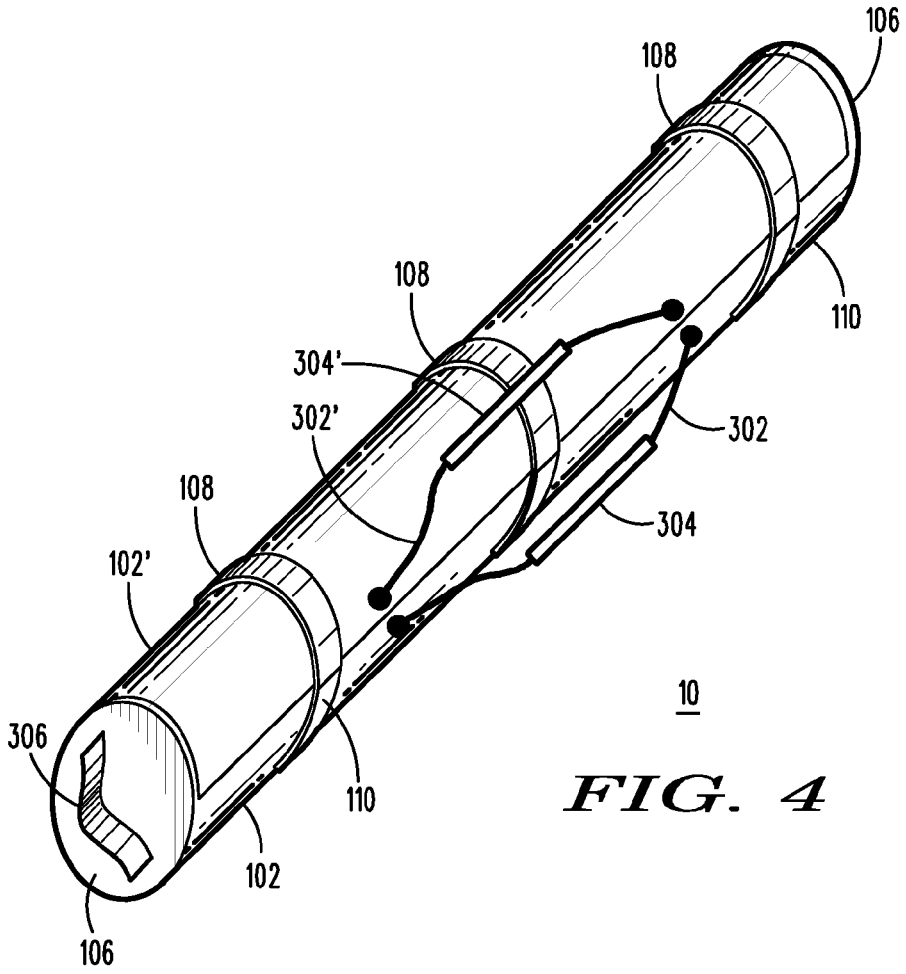
FIG. 4 is a further diagram of a closed golf club carrying case in accordance with some embodiments of the invention.

FIG. 4 is a further diagram of a closed golf club carrying case in accordance with some embodiments of the invention. In this embodiment, the handle comprises two sections of rope 302 and 302', with sleeves 304 and 304'. Each rope is attached to one elongated shell 102 or 102'. In one embodiment, the ropes are attached either side of the opening, so that tension in the ropes tends to hold the golf club carrying case shut. In a further embodiment, the ropes are attached one each side of the hinge, so that the hinge resists any tendency of the golf club carrying case to bend while being carried.

Figure 5:
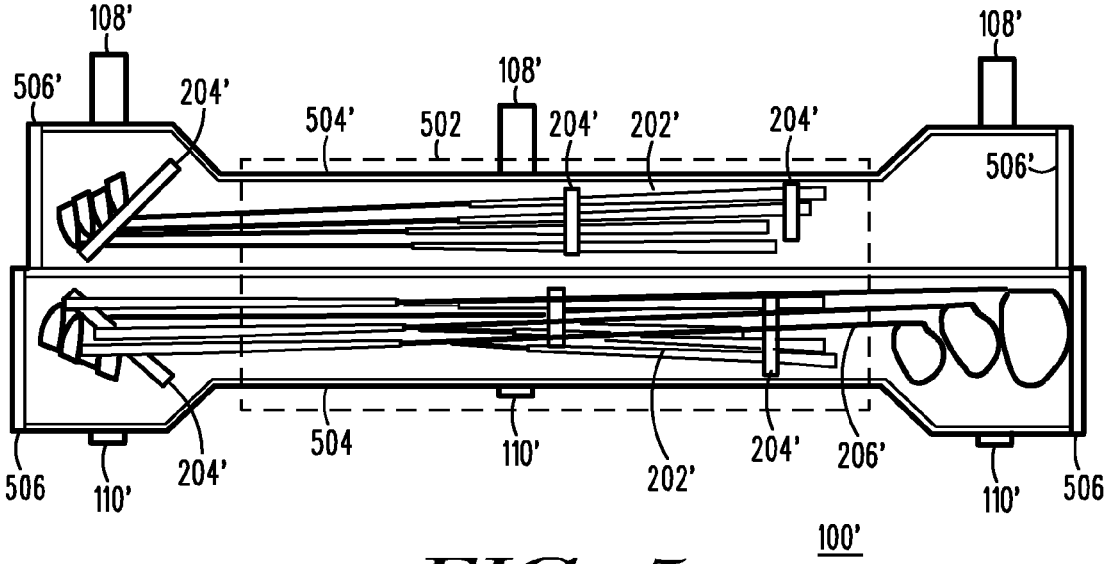
FIG. 5 is a diagram of a further open golf club carrying case in accordance with some embodiments of the invention.

FIG. 5 is a diagram of a further open golf club carrying case in accordance with some embodiments of the invention. In this embodiment, the golf club carrying case 100' comprises a first elongated shell 504 with ends 506 and a second elongated shell 504' with ends 506' that together form an elongated housing. The cross-section of the golf club carrying case 100' is reduced in a central region 502, relative to the end regions. The central region 502 holds the shafts of the golf clubs, which require less space than the heads. In this embodiment, the maximum cross-dimension of the central region 502 of the elongated housing is less than the maximum cross-dimension of either end of the elongated housing.

The first and second elongated shells are coupled along one longitudinal edge by one or more hinges 104'. The hinge 104' allows the first and second shells to be brought together to form a closed case. In this example, the closed case is a tube. In general, the closed shells form an elongated housing. The first shell 504 includes ends 506 and the second shell 504' includes ends 506'. The shells and their ends are made of a substantially rigid material, such as a plastic. The ends may be circular (or other shape) such that when the shells are brought together, the ends 506' are inside the tube so that ends of the closed tube have double thickness to increase strength. Alternatively, the shells 504 and 504' may have equal lengths and the ends may be semi-circular (or other shape) such that the ends butt together when the shells are brought together.

The shells are held together by closing mechanisms 108' and 110'. 108' and 110' may be constructed of hook-and-loop material for example. Other locking mechanisms may be used such as zips, latches, snaps, elastic bands and straps with buckles.

In FIG. 5, the golf club carrying case 100' holds golf clubs 202', such as irons, wedges and putters, held in place by one or more restraints 204'. The restrains may be elastic straps, hook-and-loop straps, foam inserts, clips, or dividers, for example. The golf club carrying case also holds larger golf clubs 206', such as woods or drivers. Soft inserts may be used to hold clubs in position and protect them from movement.

Figure 6:
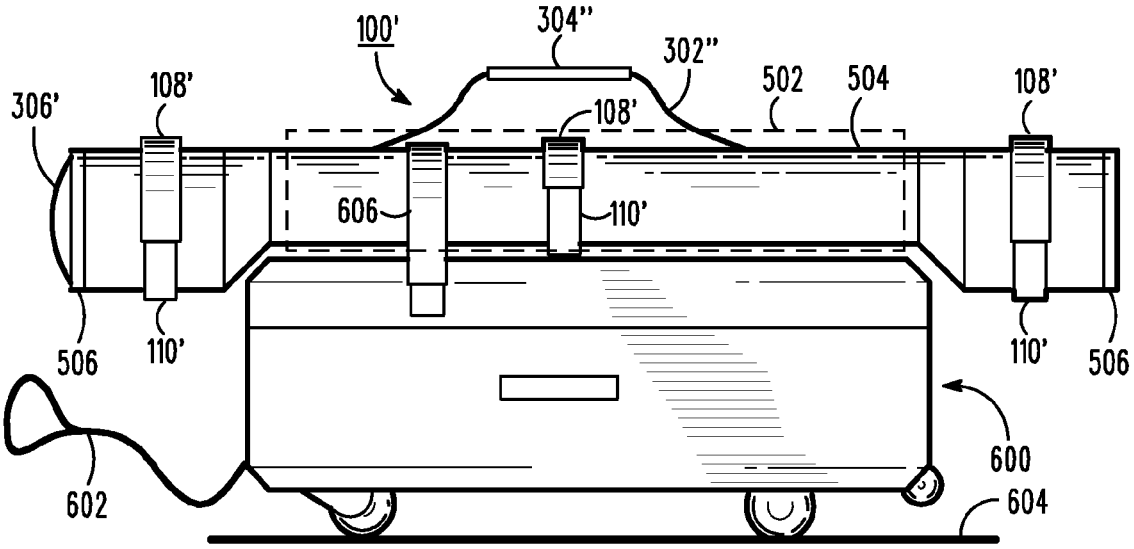
FIG. 6 is a diagram of a closed golf club carrying case in accordance with some embodiments of the invention.

FIG. 6 is a diagram of a closed golf club carrying case 100' in accordance with some embodiments of the invention. The golf club carrying case 100' is shown supported by a wheeled suitcase 600 as described in the co-pending application Ser. No. 12/333,110, titled 'Stackable, Towable Luggage'.

The region of reduced cross-section 502 is supported by the wheeled suitcase 600 such that the ends of the golf club carrying case overhang the suitcase and prevent the golf club carrying case from sliding backwards or forwards as the suitcase 600 is moved by handle 602 across a surface 604. The golf club carrying case may be located in a longitudinal depression in the upper surface of the suitcase 600. In one embodiment, the golf club carrying case 100' is restrained by a strap or other attachment mechanism 606. Part or all of the attachment mechanism 606 may be permanently attached to the golf club carrying case 100'. Alternatively, the attachment mechanism 606 may be coupled to the suitcase 600.

When closed, the closing mechanisms 108' and 110' in FIG. 6 are engaged and the two shells are held together to form a tube of varying cross-section. The golf club carrying case may be carried in a substantially horizontal orientation using carrying handle 302'. The handle 302' may be a flexible handle, such as a strap or rope, or a rigid handle, for example. When a flexible handle is used, a sleeve 304' may be placed over the strap to provide a more comfortable grip or to increase the stiffness of the handle in the central region.

In the sequel, references to the first and second elongated shells 102 and 102' are taken to also refer to the first and second elongated shells 504 and 504'. Similarly, references to parts in a particular embodiment are taken to apply to corresponding parts in other embodiments.

The first and second elongated shell 102 and 102' and the hinge 104 may be formed as regions of a single structure, the hinge region being thinner than the first and second elongated shell regions. The closing mechanism may also be formed as regions of the single structure.

Figure 7:
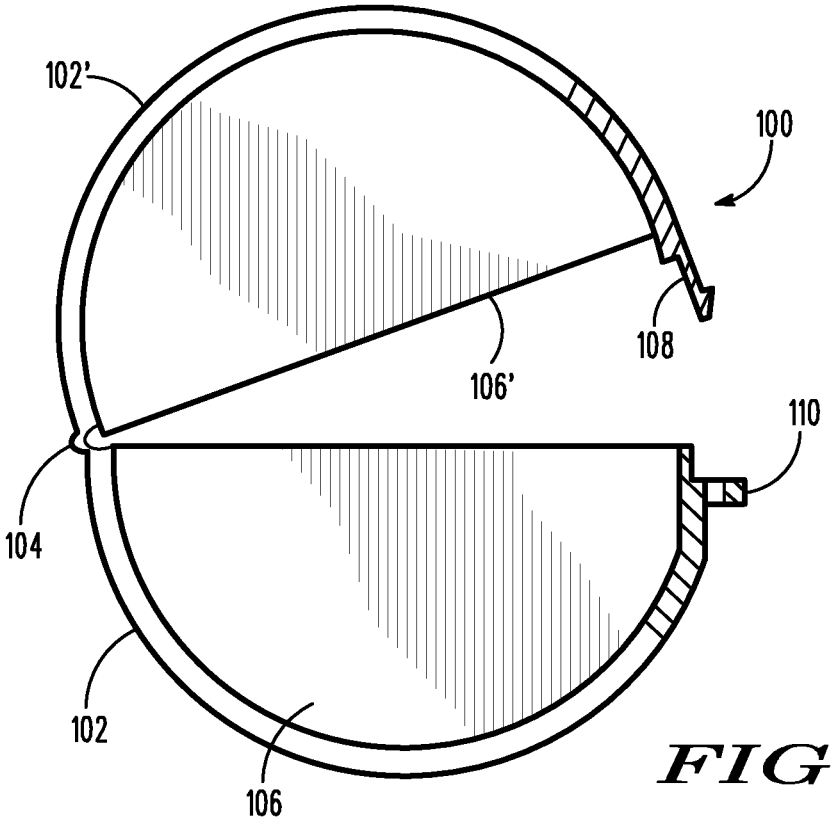
FIGS. 7, 8, and 9 are cross-sectional views of a golf club carrying case in accordance with some embodiments of the invention.
Figure 8:
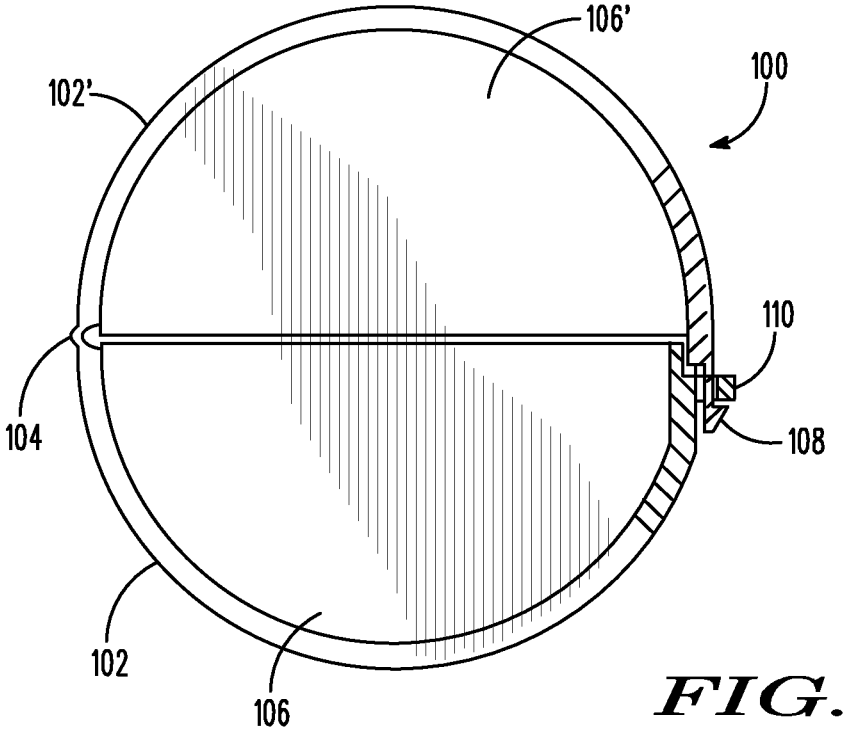

FIGS. 7 and 8 are cross-sectional views of a golf club carrying case in accordance with some embodiments of the invention. FIG. 7 shows the golf club carrying case 100 in a partially open configuration. The carrying case is formed substantially from a single structure. First and second elongated shells 102 and 102' are coupled by a hinge 104 along one edge. The material thickness in the hinge 104 is thinner than the material thickness in the shells 102 and 102', so that the hinge is flexible whereas the shells are more rigid. In operation, the hinge 104 is flexed to allow the case to be opened or closed. A latch 108 and corresponding catch 110 are also integrated with the single structure. The material thickness of the latch 108 is chosen so that the latch springs back into position following a deflection. The material may be plastic, for example, and the structure may be formed by injection molding. It will be apparent to those of ordinary skill in the art that the structure could alternatively be formed as two structures that are connected by a hinge 104.

FIG. 8 shows the carrying case 100 in a closed configuration. To close the case, the latch 108 is passed through an opening in the catch 110 so that a hook on the end of the latch engages the underside of the catch 110. Spring tension in the latch 108 holds it in the engaged or caught position. To open to case 100, the end of the latch 108 is pressed inwards to allow it to pass through the opening in catch 110. The carrying case may have multiple latches.

Figure 9:
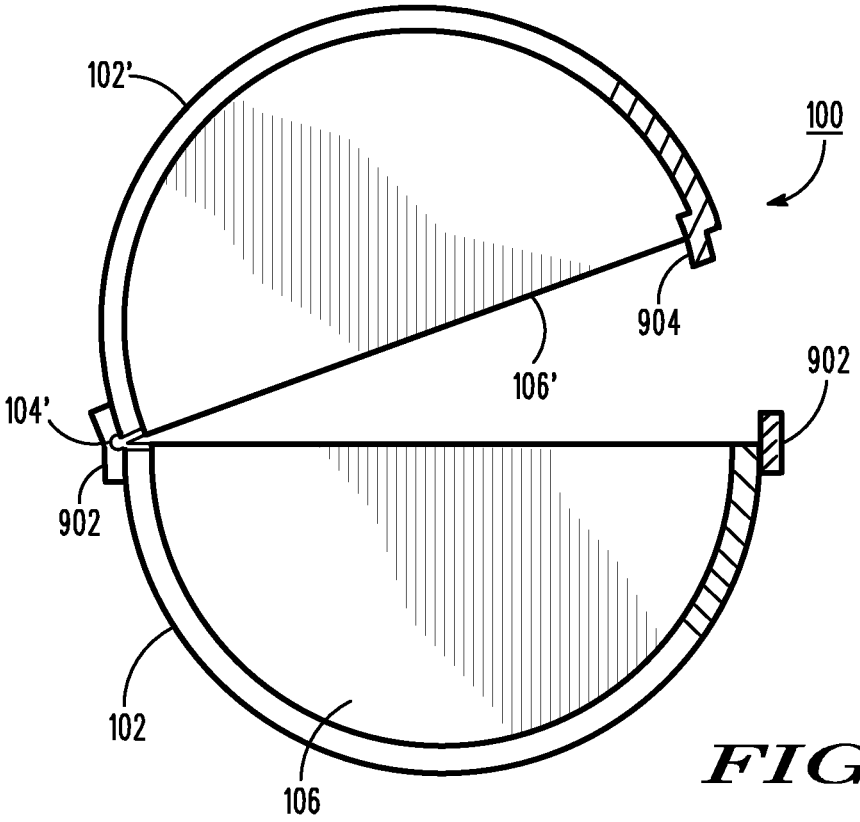

FIG. 9 is a cross-sectional view of a golf club carrying case in accordance with some embodiments of the invention. FIG. 9 shows an embodiment that includes a protective strip or bumper 902 that encompasses the perimeter of the elongated shell 102. The strip 902 is constructed of robust material such as a metal or a rubber-like material. The strip 902 can serve several purposes. Firstly, it protects the elongated cases 102 and 102' from damage. Secondly, it can provide additional strength to help maintain the shape of the elongated shell 102. Thirdly, it acts as a guide and restraint to ensure that the upper elongated 102' aligns with the lower elongated shell 102 when the case is closed. Alignment is further aided by one or more protrusions 904 on the inner rim of the upper elongated shell 102'. These protrusions may be integral with the upper elongated shell 102'. In one embodiment, a rubber-like strip 902 covers and protects the hinge 104', as shown in the figure. The hinge 104' may be a separate component, as shown in FIG. 9. Alternately, the hinge 104 may be integral with the protective strip 902, such as hinge 104 shown in FIG. 7, for example.

Figure 10:
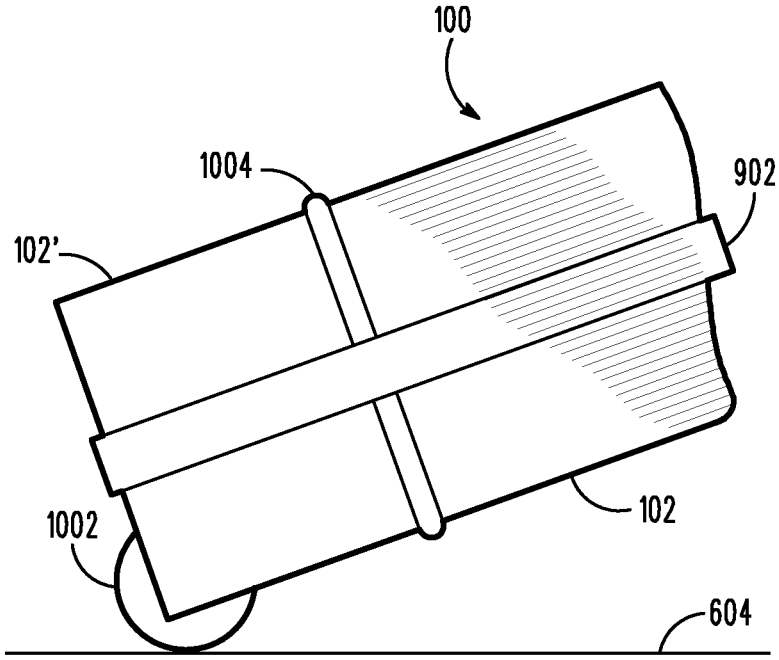
FIG. 10 is a diagram of a wheeled golf club carrying case in accordance with some embodiments of the invention.

FIG. 10 is a diagram of a wheeled golf club carrying case in accordance with some embodiments of the invention. Referring to FIG. 10, one or more wheels 1002 are coupled to one end of the elongated shell 102. These wheels allow the carrying case 100 to be pulled or pushed using a handle at the other end of the case. A single wheel may be in the form of a roller having a width (2-4 inches for example) that is sufficient to provide a stable base. When two of more wheels are used, they are spaced apart to provide a stable base. The wheels may be retractable or fixed.

The carrying case 100 may also include one or more circumferential bands 1004. These bands may be constructed of a rubber-like material or a rigid material. When the case is transported on top of another case or cart, the bands 1004 prevent axial motion of the carrying case 100 relative the transporting case.

FIG. 11 is a cross-section of a further golf club carrying case in accordance with certain embodiments of the invention. In FIG. 11, the closing mechanism comprises a first zip fastener 1102 that connects the first and second elongated shells 102 and 102'. A foldable gusset 1104 is attached to the perimeter of the first elongated shell 102. A second zip fastener 1106 may be closed to maintain the foldable gusset 1104 in a folded configuration (as shown) and opened to allow the foldable gusset 1104 to be unfolded and thereby increase the interior volume of the golf club carrying case 100. Similar expandable gussets are commonly used in soft-sided suitcases.

FIG. 12 is a diagram of a collapsible golf bag in accordance with some embodiments of the invention. Referring to FIG. 12, the collapsible golf bag 1200 comprises an elongated flexible bag 1202 suspended from a substantially rigid frame 1204. The flexible bag 1202 may have a bellows or concertina form that allows it extended to a length sufficient to carry golf clubs, but also enables it to be compressed to a much shorter length as shown in FIG. 13. Referring again to FIG. 12, one or more hooks or other attachments 1206 are coupled to the frame 1204 to enable the bag to be suspended from a golf cart or other structure. When suspended by the hook, the weight of the golf clubs extends the flexible bag 1202. The hooks may be attached by a swivel or hinge joint so that they can be folded down when the bag is collapsed. The width of frame, shown as 'w' in FIG. 12, is such that the collapsible golf bag 1200 may be transported within a golf club carrying case of the type described above.

An additional bag 1208 may be attached to the collapsible golf bag 1200 using clips 1210, for example. The additional bag 1208 may be used to carry accessories.

In some embodiments, a shoulder strap 1212 is removably or permanently attached to the frame 1204 and to the body of the bag. A carrying handle 1214 may be also be used for carrying the golf bag.

FIG. 13 shows the collapsible golf bag in a collapsed configuration. In the collapsed configuration, the height 'h' of the collapsed bag and the width of the frame are such that the collapsible golf bag 1200 may be transported within a golf club carrying case of the type described above.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A golf club carrying case comprising:

a wheeled suitcase having an upper surface;

first and second elongated shells;

a hinge connecting the first and second elongated shells along a first longitude edge;

at least one closing mechanism configured to hold the first and second elongated shells together along a second longitude edge to form an elongated housing having a central region, a first end region, and a second end region, the elongated housing having an interior length sufficient to house a golf club, wherein the central region of the elongated housing is recessed over a length no less than a length of the upper surface of the wheeled suitcase, such that when the central region of the golf club carrying case is supported by the upper surface of the wheeled suitcase, the first and second end regions of the golf club carrying case overhang the wheeled suitcase at both ends to prevent the golf club carrying case from sliding backwards on the wheeled suitcase and prevent the golf club carrying case from sliding forwards on the wheeled suitcase; and at least one restraint coupled to at least one of the first and second elongated shells and configured to restrain golf clubs within the elongated housing.

2. A golf club carrying case in accordance with claim 1, wherein the first and second elongated shells are shaped such that the first end region of the elongated housing is large enough to accommodate the heads of a plurality of driver clubs and wherein the lengths of the first and second elongated shells are sufficient to accommodate a maximum length of a driver club.

3. A golf club carrying case in accordance with claim 1, wherein the first and second shells are substantially hemicylindrical in shape and wherein the diameter of the elongated housing formed by the first and second elongated shells is no more than approximately six inches.

4. A golf club carrying case in accordance with claim 1, wherein a restraint of the at least one restraint comprises an elastic strap.

5. A golf club carrying case in accordance with claim 1, wherein a restraint of the at least one of restraint comprises a hook-and-loop fastener.

6. A golf club carrying case in accordance with claim 1, wherein the maximum cross-dimension of the first end region of the elongated housing first is no more than approximately six inches.

7. A golf club carrying case in accordance with claim 5, wherein the golf club case is sized to accommodate a set of 14 golf clubs.

8. A golf club carrying case in accordance with claim 1, wherein:

the first elongated shell is a single element having first and second end portions coupled by a central portion, the central portion greater in length than either end portion;

the second elongated shell is a single element having first and second end portions coupled by a central portion; and the recessed central region is formed by the central portions of the first and second elongated shells.

9. A golf club carrying case in accordance with claim 1, further comprising an attachment mechanism for attaching the golf club carrying case to the exterior of a wheeled suitcase.

10. A golf club carrying case in accordance with claim 1, wherein the first and second elongated shells comprise plastic shells.

11. A golf club carrying case in accordance with claim 1, further comprising a first handle configured to allow the golf club carrying case to be held in a substantially horizontal orientation.

12. A golf club carrying case in accordance with claim 11, wherein the first handle comprises a first flexible strap attached to the first elongated shell at a location opposite the hinge and a second flexible strap attached to the second elongated shell at a location opposite to the hinge.

13. A golf club carrying case in accordance with claim 1, further comprising a second handle attached to an end of the elongated housing.

14. A golf club carrying case in accordance with claim 1, wherein the closing mechanism comprises a mechanism selected from the group of mechanisms consisting of a latch, a zip and a strap with a hook-and-loop fastener.

15. A golf club carrying case in accordance with claim 1, wherein the ends of the first elongated shell overlap the ends of the second elongated shell when the golf club carrying case is closed.

16. A golf club carrying case in accordance with claim 1, wherein the sum of the length, width and depth of the elongated housing formed by the first and second elongated shells is no more than approximately 62 inches.

17. A golf club carrying case in accordance with claim 1, further comprising a protective strip encompassing the perimeter of the first elongated shell.

18. A golf club carrying case in accordance with claim 1, further comprising at least one circumferential band positioned to inhibit axial motion of the golf club carrying case relative to a supporting surface.

19. A golf club carrying case in accordance with claim 1, further comprising a shoulder strap fixedly or removably coupled to the elongated housing.

20. A golf club carrying case in accordance with claim 1, further comprising:

a collapsible golf bag having a substantially rigid frame configured to support a collapsible flexible bag, wherein the width of rigid frame and the height of the flexible bag are such that the collapsible golf bag may be accommodated within the golf club carrying case.

21. A golf club carrying case in accordance with claim 20, wherein the collapsible golf bag further comprises:

at least one carrying strap; and at least one hook configured to attach the collapsible golf to a golf cart.

22. A golf club carrying case in accordance with claim 20, further comprising:

an accessories bag removably attached to the collapsible golf.

23. A golf club carrying case in accordance with claim 20, wherein the maximum cross-dimension of the first end of the elongated housing first is no more than approximately six inches.

24. A golf club carrying case in accordance with claim 1, wherein the closing mechanism comprises a first zip fastener operable to connect the first and second elongated shells, the golf club carrying case further comprising:

a foldable gusset around the perimeter of the first elongated shell; and second zip fastener that may be closed to maintain the foldable gusset in a folded configuration and opened to allow the foldable gusset to be unfolded and thereby increase the interior volume of the golf club carrying case.

25. A golf club carrying case in accordance with claim 1, the elongated housing further comprising:

a region, located between longitudinal edges of the first and second elongated shells, that forms a hinge, the material in the region being thinner than the material in the first and second elongated shells.

26. A golf club carrying case in accordance with claim 25, further comprising:

a latch integrated with the first elongated shell; and a catch integrated with the second elongated shell and positioned to engage the latch in the first elongated shell.

27. A golf club carrying case in accordance with claim 1, further comprising:

a latch integrated with the first elongated shell; and a catch integrated with the second elongated shell and positioned to engage the latch of the first elongated shell.

28. A golf club carrying case in accordance with claim 11, where the elongated housing is recessed on a first side of the central region and where the first handle is attached to a second side of the elongated housing opposite the first side, such that when the first side is placed on top of a wheeled suitcase, the first handle is uppermost.

* * * * *

UNITED STATES PATENT AND TRADEMARK OFFICE

CERTIFICATE OF CORRECTION

PATENT NO. : 9,084,920 B2
APPLICATION NO. : 13/313138
DATED : July 21, 2015
INVENTOR(S) : Scott E. Andochick It is certified that error appears in the above-identified patent and that said Letters Patent is hereby corrected as shown below:

In the Claims

Col. 8, line 35 the word "bag" should follow the word "golf" in claim 22.

Signed and Sealed this
Twenty-second Day of December, 2015

Michelle K. Lee

Michelle K. Lee
*Director of the United States Patent and Trademark Office*